United States Patent [19]

Cory

[11] 4,074,663

[45] Feb. 21, 1978

[54] INTERNAL COMBUSTION ENGINE AND COOLING FAN DRIVE SYSTEM

[75] Inventor: Halsey W. Cory, Fairfield, Ohio

[73] Assignee: Force Control Industries, Inc., Hamilton, Ohio

[21] Appl. No.: 570,646

[22] Filed: Apr. 23, 1975

[51] Int. Cl.[2] ..... F01P 7/02; F16D 13/60

[52] U.S. Cl. ..... 123/41.12; 192/18 A; 192/70.12; 192/82 T; 192/113 A; 192/113 B

[58] Field of Search ..... 123/41.11, 41.12, 41.49, 123/41.58, 41.65; 192/113 A, 113 B, 82 T, 70.12, 18 A, 91 A

[56] References Cited

U.S. PATENT DOCUMENTS

| | | | |
|---|---|---|---|
| 1,452,609 | 4/1923 | Klocke | 192/113 A |
| 2,667,954 | 2/1954 | Danly | 192/113 A |
| 2,879,872 | 3/1959 | Van Ranst | 192/70.12 |
| 3,207,279 | 9/1965 | Ahlen | 192/82 T |
| 3,366,210 | 1/1968 | Webster | 192/70.12 |
| 3,587,537 | 6/1971 | Spokas | 123/41.12 |
| 3,605,963 | 2/1970 | Roob | 192/113 B |
| 3,638,773 | 2/1972 | Lewis | 119/113 B |
| 3,792,697 | 2/1974 | Walter | 123/41.12 |
| 3,841,455 | 10/1974 | Eastwood | 192/113 B |
| 3,858,697 | 1/1975 | Brewer | 123/41.12 |
| 3,915,269 | 10/1975 | Houser | 192/18 A |

*Primary Examiner*—Charles J. Myhre
*Assistant Examiner*—Daniel J. O'Connor
*Attorney, Agent, or Firm*—Jacox & Meckstroth

[57] ABSTRACT

An internal combustion engine has a projecting crankshaft on which a sleeve is mounted for supporting a set of annular clutch plates disposed in interfitting relation with a set of annular clutch discs. The clutch discs are mounted on a cooling fan support shaft which is aligned with the crankshaft and is rotatably supported by a clutch housing secured to an oil pump housing mounted on the engine block. The lubricating oil for the engine is also pumped axially through the sleeve and outwardly between the clutch plates and discs which are movable between a clamped position and a released position in response to axial movement of an air actuated non-rotating annular piston surrounding the crankshaft. The piston may also be actuated to engage an annular brake surrounding the crankshaft when it is desired to brake the output shaft and prevent rotation of the cooling fan.

7 Claims, 3 Drawing Figures

INTERNAL COMBUSTION ENGINE AND COOLING FAN DRIVE SYSTEM

BACKGROUND OF THE INVENTION

In the art of water cooled internal combustion engines wherein an axial flow fan is supported for rotation adjacent a water cooling radiator and is driven by the engine, it is common to use a clutch between the fan and the engine drive shaft. The actuation of the clutch is controlled in response to the temperature of either the air flowing through the radiator or the cooling liquid being circulated through the engine and radiator so that the engine is operated within a predetermined temperature range. For example, U.S. Pat. No. 3,584,716 discloses a viscous fluid clutch which mounts on a drive shaft and incorporates a rotary valve member actuated by a bimetallic temperature sensing element for controlling the circulation of the fluid within the clutch.

Another form of clutch which has been used to drive an engine cooling fan, is disclosed in a 1974 publication No. 74-DE-12 of the American Society of Mechanical Engineers, entitled "A New Wet Clutch Fan Drive System". This drive system incorporates a stationary shaft which is supported by a bracket and on which is mounted both a rotary clutch housing driven by V belts and a rotary fan support hub. The clutch housing is connected or coupled to the fan support hub by a series of interfitting clutch discs which are operated in cooling oil, and the oil is circulated through an external heat exchanger. The series of clutch discs are actuated between clamped and released positions by axial movement of a non-rotating piston supported by the stationary shaft. Fluid to actuate the piston is controlled by a valve which operates in response to movement of a temperature sensing element such as a wax type heat motor.

In the operation of a "wet" clutch such as disclosed in the above mentioned publication, it is desirable to have a forced or positive flow of oil outwardly between the relatively rotating clutch plates or discs to create an "oil shear" action, especially during the time the clutch discs are being compressed together or engaged. Thus wearing of the discs is substantially eliminated, and the clutch is provided with dependable operation over a substantially long period of service time. It is also desirable for such a clutch to be of construction and operation so that both the construction cost and the maintenance cost are minimized.

Furthermore, with respect to cooling fans used in conjunction with large horsepower engines, for example, such as installed on buses and trucks, it is frequently desirable to provide for driving the fan either at the full speed of the engine with no slip between the fan and the engine shaft or to stop the fan so that it has no rotation. For example, when the engine is being operated on a cold day, and the cold air is sufficient to cool the engine, it is desirable to prevent even "windmilling" of the fan at a few hundred rpm.

SUMMARY OF THE INVENTION

The present invention is directed to an improved internal combustion engine and fan drive system which provides all of the desirable advantages mentioned above. In accordance with the illustrated embodiment of the invention, an oil shear clutch is mounted directly on a projecting end portion of the engine crankshaft and provides for driving the cooling fan at the speed of the engine crankshaft when it is desired to effect cooling of the engine. The fan drive system of the invention also provides for braking the fan to prevent it from rotating and for accommodating slight eccentric or orbital movement of the engine crankshaft. In addition, the drive system provides for circulating the engine lubricating oil outwardly between the series of clutch plates and discs to assure the presence of an oil shear film between the clutch plates and discs.

Other features and advantages of the invention will be apparent from the following description, the accompanying drawing and the appended claims.

DESCRIPTION OF THE PREFERRED EMBODIMENT

Figure 1:
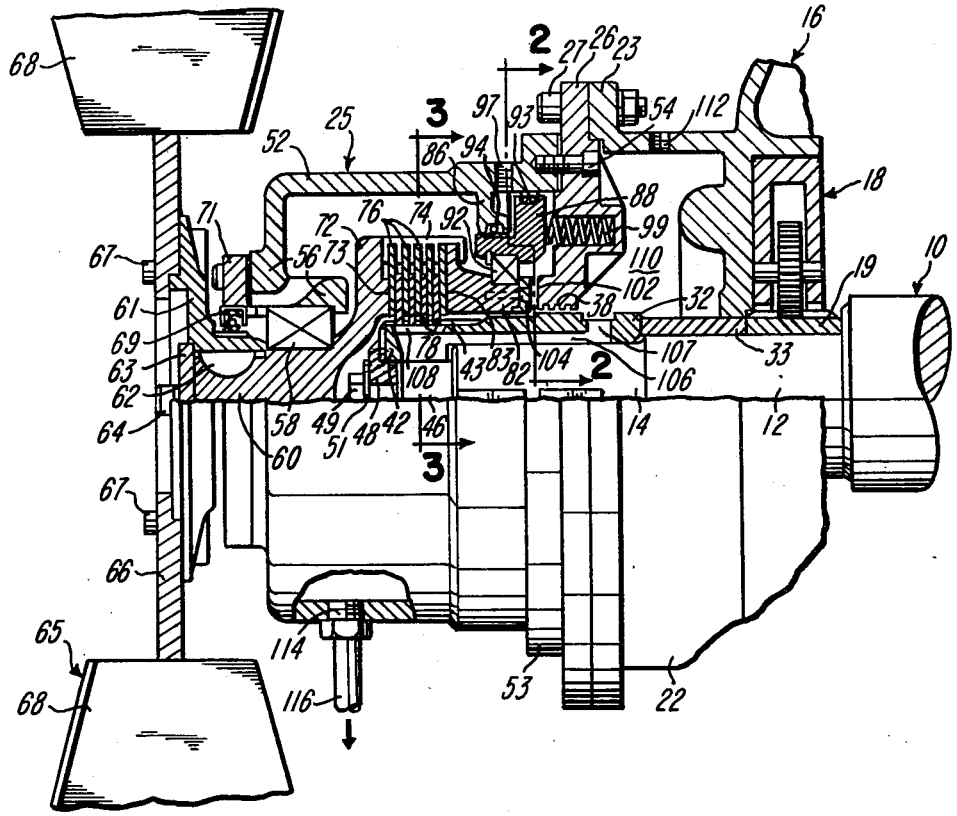
FIG. 1 is an elevational view of an engine cooling fan drive system constructed and mounted in accordance with the invention and with the upper portion of the system shown in axial section to illustrate the internal details of construction.
Figure 2:
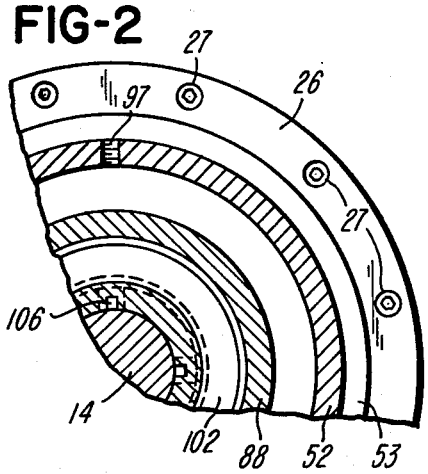
FIG. 2 is a fragmentary section taken generally on the line 2—2 of FIG. 1.

Referring to FIG. 1, an internal combustion engine has a crankshaft 10 which includes a forwardly projecting first cylindrical portion 12 and a second cylindrical portion 14 of progressively smaller or stepped diameters. The crankshaft 10 projects from the engine block through an oil pump housing 16 which is secured to the engine block and encloses a gear type oil pump, diagrammatically referred to as 18 and driven by a gear 19 mounted on the crankshaft portion 12. The oil pump 18 is primarily used for circulating oil for lubrication throughout the engine.

The oil pump housing 16 includes a forwardly projecting cylindrical portion 22 having an outwardly projecting annular flange 23. A fan drive system 25 includes a generally flat annular plate or wall member 26 which is secured to the flange 23 by a series of peripherally spaced bolts 27. A generally cylindrical sleeve 32 is mounted on the crankshaft portion 14 and has an inner end which abuts a cylindrical spacer 33 mounted on the crankshaft portion 12 and engaging the oil pump drive gear 19. The annular wall member 26 has an inner bore which closely surrounds the sleeve 32 and defines a labyrinth-type seal 38 around the sleeve.

The sleeve 32 includes a forward end portion 42 which has an external spline 43 and an inner bore for receiving a cylindrical spacer 46 positioned adjacent the forward end surface of the crankshaft 10. The assembly of the sleeve 32, spacer 33 and gear 19 are rigidly secured to the crankshaft 10 along with the spacer 46 by an annular retainer collar 48 and a machine screw 49 threaded into the forward end portion of the crankshaft 10. The screw is locked by bent tabs (not shown) of a locking washer 51.

A housing 52 has an outwardly projecting end flange 53 which is secured to the annular wall member 26 by a series of circumferentially spaced screws 54. The housing 52 includes a forward end portion 56 which retains an antifriction bearing 58. An output shaft 60 is supported for rotation by the bearing 58, and a fan support hub 61 is mounted on the forward end portion of the shaft 60 and is secured to the shaft by a key 62, a retainer plate 63 and a screw 64. An axially flow engine cooling fan 65 includes a center plate 66 which is mounted on the hub 61 and is secured thereto by a series of circumferentially spaced screws 67. In a conventional manner, the fan 65 includes a series of peripherally spaced angled fan blades 68 which are spaced around the center support plate 66. An annular oil seal 69 engages a cylindrical surface on the hub 61 and is retained within an annular end plate 71 secured to the housing 52.

Figure 3:
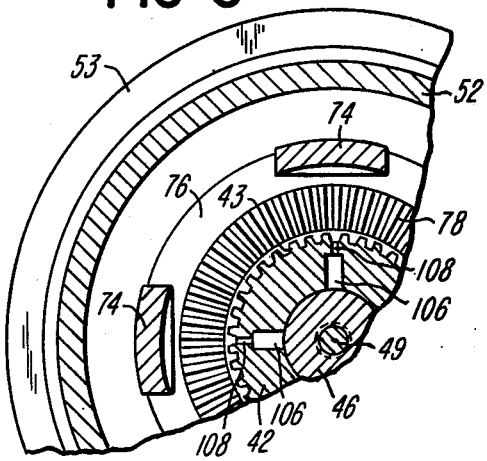
FIG. 3 is another fragmentary section taken generally on the line 3—3 of FIG. 1 and shown on a slightly larger scale.

The output shaft 60 includes an inner annular portion 72 which has a radial pressing surface 73 and a plurality of four circumferentially spaced and axially extending elongated keys or lugs 74 (FIG. 3). A plurality or set of annular clutch discs 76 have external notches for receiving the lugs 74 and are positioned in interfitting relation with a corresponding set of clutch plates 78 which are keyed to the external spline 43 on the forward end portion of the crankshaft sleeve 32. Preferably, the series of interfering clutch discs 76 and clutch plates 78 are constructed in a manner as disclosed in U.S. Pat. No. 3,638,773 which issued to the assignee of the present invention.

An annular clutch or thrust member 82 surround the sleeve 32 and has external notches for receiving the lugs 74 so that the thrust member 82 rotates with the output shaft 60. The thrust member 82 is adapted to move axially and has a radial surface 83 which cooperates with the radial surface 73 to confine the series of interfitting clutch discs 76 and plates 78.

The housing 52 includes an integral annular 86 which projects inwardly and cooperates with the wall member 26 to define an annular chamber which receives an annular non-rotating piston 88. The piston 88 is connected to the annular thrust member 82 by an anti-friction thrust bearing 92 so that the non-rotating piston 88 and the rotatable thrust member 82 move axially as a unit. The piston 88 carries a ring seal 93, and the housing wall 86 supports a ring seal 94 so that a substantially air tight annular chamber is defined between the housing wall 86 and the piston 88. This chamber is adapted to receive pressurized air through an air supply line connected to a threaded opening 97 within the housing 52. Preferably, the air supply line is connected through a thermally responsive valve (not shown) to the main air reservoir tank which supplies air for the air brake system of the vehicle. Normally, the reservoir tank stores a supply of air at a pressure on the order of 100 psi.

The annular piston 88 is normally urged to the left (FIG. 1) to effect clamping of the clutch discs and plates, by a set of circumferentially spaced compression coil springs 99 which are retained within corresponding axially extending holes or bores formed within the annular wall member 26. The wall member 26 also forms an annular brake surface 102 which surrounds the sleeve 32. The brake surface 102 opposes a corresponding brake surface formed on an annular brake disc 104 secured to the rearward end of the annular thrust member 82.

Referring to FIGS. 1 and 3, a set of four circumferentially spaced passages 106 extend axially through the sleeve 32 adjacent the outer cylindrical surfaces of the crank shaft portion 14 and the spacer 46. The passages 106 are formed by corresponding internal slots within the sleeve 32 similar to keyways. Each of the passages 106 has an inlet 107 and an outlet defined by a corresponding slot 108 (FIG. 3) extending to the inner edge surfaces of the clutch discs 76 and clutch plates 78.

In the operation of the fan drive system, engine lubricating oil is pumped from the gear pump 18 into the annular chamber 110 through a conduit which is connected to the chamber through an oil inlet 112. The oil is supplied to the chamber at a pressure of between 5 and 25 psi, depending upon the speed of the engine crankshaft 10. The pressurized oil is forced through the inlets 107 of the passages 106 and outwardly through the corresponding slots 108 so that the oil flows outwardly in films between the interfitting clutch discs 76 and clutch plates 78 when the clutch plates and discs are released and the fan 65 is not rotating. The oil which flows outwardly from the discs 76 is collected within the housing 52 and drains through an oil outlet 114 connected by a conduit 116 to the oil sump within the bottom cover or pan for the engine.

When the temperature of the engine cooling system rises to a predetermined upper limit, it is sensed by a thermally actuated valve which releases the air pressure on the left side of the piston 88 so that the piston moves to the left as a result of the force exerted by the compression springs 99. The movement of the piston 88 moves the annular thrust member 82 to the left so that the clutch discs 76 and plates 78 are clamped together between the surfaces 73 and 83. This actuation of the clutch causes the output shaft 60 to be locked-up with the engine crankshaft 10 so that the fan 65 is driven at the same speed as the crankshaft.

When the temperature of the engine cooling fluid decreases to a predetermined lower limit, the thermal sensing valve opens and allows pressurized air to enter the inlet 97 and move the piston 88 to the right against the force exerted by the springs 99 so that the clutch plates and discs are released and the fan 65 is disengaged. As the air pressure continues to move the piston 88 to the right, the brake ring 104 engages the brake surface 102 and stops or brakes the rotation of the thrust member 82, the output shaft 60 and the fan 65. Preferably, the movement of the piston 88 is relatively slow so that the fan 65 has an opportunity to decelerate to a low speed relative to the speed of the crankshaft 10 before the output shaft 60 is braked. This cycle of operation continues so that the operating temperature of the engine is maintained within the predetermined range.

From the drawing and the above description, it is apparent that an internal combustion engine incorporating a fan drive control system constructed in accordance with the present invention, provides desirable features and advantages. For example, the drive control system provides for a direct drive from an engine crankshaft to the cooling fan so that, when desired, the fan will operate at the same speed as the crankshaft without any significant horsepower loss within the fan drive system. Thus the system is ideally suited for use in connection with high horsepower engines which are commonly used on vehicles such as buses and trucks. The control system is also dependable in operation and will provide continuous cycles of operation with a minimum of maintenance. Furthermore, the drive system uses the engine lubricating oil and is effective to pump the oil outwardly between the clutch discs and clutch plates to provide a highly effective oil shear clutch operation. That is, the system assures a continuous circulation of a film of oil between the adjacent clutch discs and plates so that there is substantially no wear during the operation of clamping the plates and discs together for engaging the clutch.

As another feature, the fan drive control system provides for braking the cooling fan and preventing it from rotating when it is desired to minimize the flow of air through the radiator, for example, when the engine is being operated on a cold day. The springs 99 are also effective to assure that a clutch is engaged and that the cooling fan 65 will be driven in the event there is a failure of the air supply line connected to the inlet 97. A further important feature is that the control system will accommodate slight gyrational orbital movement of the outer end portion of the crankshaft 10, which is not uncommon on high horsepower engines. That is, when the clutch is released, the clutch plates 78 are free to orbit with the outer end portion of the crankshaft, and when the clutch is engaged, the external spline connection 43 permits orbital movement of the outer end portion of the crankshaft and the sleeve 32 within the clutch plates 78.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In an internal combustion engine including a crankshaft having a projecting end portion and a rotary fan for cooling the engine, an improved system for driving said fan with said crankshaft, comprising a set of interfitting annular clutch plates and annular clutch discs, a removable sleeve mounted on said end portion of said crankshaft in surrounding relation and supporting said clutch plates for rotation therewith, means for retaining said sleeve on said end portion of said crankshaft, a housing supported by said engine and enclosing said clutch plates and clutch discs, an output shaft supporting said fan, bearing means retained by said housing and supporting said output shaft and said fan for rotation on an axis aligned with the axis of said crankshaft, means on said output shaft for supporting said clutch discs for rotation therewith, said sleeve having means defining at least one fluid passage extending generally axially along said end portion of said crankshaft and into said clutch plates, means on said sleeve and defining a fluid outlet for said passage within said clutch plates, means on said sleeve and defining a fluid inlet for said passage spaced axially from said clutch plates, and actuator means for moving said clutch plates and discs between a clamped engaged position and a released position to control the rotation of said fan with respect to said crankshaft.

2. An engine and fan driving system as defined in claim 1 wherein said sleeve cooperates with said end portion of said crankshaft to define a plurality of said passages disposed at circumferentially spaced intervals on said end portion of said crankshaft.

3. An engine and fan driving system as defined in claim 1 and including an annular support plate connected to said housing, and means on said support plate and closely surrounding said sleeve for limiting axial flow of said fluid along said sleeve and for directing said fluid into said inlet for said passage.

4. An engine and fan driving system as defined in claim 1 including a fan support hub mounted on said output shaft adjacent said bearing means, and said output shaft includes a plurality of circumferentially spaced lugs projecting axially within said housing for supporting said clutch discs.

5. In an internal combustion engine including a crankshaft having a projecting end portion and a rotary fan for cooling the engine, an improved system for driving said fan with said crankshaft, comprising a set of interfitting annular clutch plates and annular clutch discs, a removable sleeve mounted on said end portion of said crankshaft in surrounding relation and supporting said clutch plates for rotation therewith, means for retaining said sleeve on said end portion of said crankshaft, a housing supported by said engine and enclosing said clutch plates and clutch discs, an output shaft supporting said fan, bearing means retained by said housing and supporting said output shaft and said fan for rotation on an axis aligned with the axis of said crankshaft, means on said output shaft for supporting said clutch discs for rotation therewith, said sleeve having means defining at least one fluid passage extending generally axially along said end portion of said crankshaft and into said clutch plates, means on said sleeve and defining a fluid outlet for said passage within said clutch plates, means on said sleeve and defining a fluid inlet for said passage spaced axially from said clutch plates, an annular thrust member connected to rotate with said output shaft and surrounding said sleeve, means on said thrust member and forming a first annular brake surface positioned concentrically with said crankshaft, means connected to said housing and forming a second annular brake surface opposing said first brake surface, actuator means for moving said clutch plates and discs between a clamped engaged position and a released position to control the rotation of said fan with respect to said crankshaft, and said actuator means is effective to press said first and second brake surfaces together when said clutch plates and discs are moved to said released position for braking the rotation of said fan.

6. In an internal combustion engine including a crankshaft and a rotary fan for cooling the engine, an improved system for dirving said fan with said crankshaft, comprising an input shaft portion, a set of interfitting annular clutch plates and annular clutch discs, a sleeve member mounted on said input shaft portion and supporting said clutch plates for rotation therewith, a housing supported by said engine and enclosing said clutch plates and clutch discs, an output shaft supporting said fan, bearing means retained by said housing and supporting said output shaft and said fan for rotation on an axis aligned with the axis of said input shaft portion, means on said output shaft and disposed radially outwardly of said sleeve member for supporting said clutch discs for rotation therewith, means including said sleeve member for defining at least one fluid passage extending generally axially along said input shaft portion and having a fluid outlet within said clutch plates, means including said sleeve member for defining a fluid inlet for said passage spaced axially from said clutch plates, an annular thrust member connected to rotate with said output shaft and surrounding said sleeve member, actuator means including a non-rotating fluid actuated piston connected to said thrust member by an antifriction bearing, and said actuator means being effective to move said clutch plates and discs between a clamped engaged position and a released position to control the rotation of said fan with respect to said input shaft portion.

7. In an internal combustion engine including a crankshaft and a rotary fan for cooling the engine, an improved system for driving said fan with said crankshaft, comprising an input shaft portion, a set of interfitting annular clutch plates and annular clutch discs, a sleeve member mounted on said input shaft portion and supporting said clutch plates for rotation therewith, a housing supported by said engine and enclosing said clutch plates and clutch discs, an output shaft supporting said fan, bearing means retained by said housing and supporting said output shaft and said fan for rotation on an axis aligned with the axis of said input shaft portion, means on said output shaft and disposed radially outwardly of said sleeve member for supporting said clutch discs for rotation therewith, means including said sleeve member for defining at least one fluid passage extending generally axially along said input shaft portion and having a fluid outlet within said clutch plates, means including said sleeve member for defining a fluid inlet for said passage spaced axially from said clutch plates, an annular thrust member connected to rotate with said output shaft and surrounding said sleeve member, means on said thrust member and forming a first annular brake surface positioned concentrically with said sleeve member, means connected to said housing and forming a second annular brake surface opposing said first brake surface, actuator means including a non-rotating fluid actuated piston connected to said thrust member by an antifriction bearing said actuator means being effective to move said clutch plates and discs between a clamped engaged position and a released position to control the rotation of said fan with respect to said input shaft portion, and said actuator means also being effective to press said first and second brake surfaces together when said clutch plates and discs are moved to said released position for braking the rotation of said fan.

* * * * *